United States Patent [19]

Vann

[11] 4,040,482

[45] Aug. 9, 1977

[54] OPTIONAL FIRE AND RELEASE TOOL AND METHOD

[76] Inventor: Roy R. Vann, P.O. Box 38, Artesia, N. Mex. 88210

[21] Appl. No.: 700,466

[22] Filed: June 28, 1976

[51] Int. Cl.[2] ..... E21B 23/00; E21B 43/119

[52] U.S. Cl. ..... 166/255; 166/297; 166/178; 166/64; 175/4.51

[58] Field of Search ..... 166/255, 250, 297, 64, 166/178, 315; 175/4.51

[56] References Cited

U.S. PATENT DOCUMENTS

| | | | |
|---|---|---|---|
| 2,960,165 | 11/1960 | Schramm | 166/64 X |
| 3,398,803 | 8/1968 | Lentmyler et al. | 166/297 X |
| 3,414,071 | 12/1968 | Alberts | 166/178 X |
| 3,696,865 | 10/1972 | Chapman | 166/255 X |
| 3,888,306 | 6/1975 | Wetzel | 166/255 |

*Primary Examiner*—Stephen J. Novosad
*Attorney, Agent, or Firm*—Marcus L. Bates

[57] ABSTRACT

Well bore completion method and apparatus which includes a perforating gun suspended from the end of a tubing string. A releasable coulping device is interposed between a stop means and the gun. When the releasable coupling is actuated, the gun, along with the lower marginal portion of the tubing string, is dropped to the bottom of the borehole.

A special tool is run downhole and touches bottom, then raised to contact the stop means, to thereby enable a determination to be made regarding the feasibility of firing the gun. The tool is employed to fire the gun as well as to release the releasable coupling member. Provision is made by which the above sequence of operational steps may be interrupted at any time and the tool removed from the borehole.

11 Claims, 7 Drawing Figures

OPTIONAL FIRE AND RELEASE TOOL AND METHOD

BACKGROUND OF THE INVENTION

Reference is made to my previously issued U.S. Pat. No. 3,706,344; 3,871,448; and to patent application Ser. No. 517,391; now U.S. Pat. No. 3,966,236; for further background of the invention.

In completing well bores, it is desirable to use a large casing-type gun which will efficiently perforate the casing and form passageways which extend a considerable distance back up into the formation, thereby gaining maximum potential production from the surrounding production zones. In order to satisfactorily carry out this desirable operation, it is necessary to connect the relatively large casing gun to a relatively smaller production tubing if production is to be carried out simultaneously with the firing of the gun. This expedient necessitates the employment of packer devices and vent strings along with the large casing gun. Should the gun misfire for one reason or another, a considerable amount of time and money is involved in bringing the entire tool string back to the surface of the ground where corrective action can be carried out in order to render the gun operative.

A gun will often misfire when it has been installed and left downhole for a substantial length of time prior to detonation. The usual cause of the misfire is an accumulation of debris layered over the firing head of the gun, or alternatively, a defective gun circuit. Therefore, if one could somehow determine the cause of the misfire, proper corrective action may be oftentimes employed, thereby making it unnecessary to bring the gun to the surface of the earth for correcting the cause of the misfire.

Therefore, it is desirable to have made available a well completion apparatus combined with a special wireline actuated tool wherein the tool can be run downhole in order that a determination can be made regarding the operable condition of a jet gun. At this time, it would be desirable for the wireline operator to be able to either fire the gun, or alternatively, bring the tool back out of the hole so that other tool strings can be run downhole to carry out various corrective actions upon the gun. On the other hand, should the gun be in proper condition for firing, it would accordingly be desirable to be able to fire the gun, permit the well to produce, while at the same time the gun is dropped to the bottom of the borehole and the tool removed from the producing well.

SUMMARY OF THE INVENTION

This invention relates to method and apparatus for completing a well bore wherein a perforating device, such as a jet-type perforating gun, is located downhole on the end of a tubing string, and a releasable coupling is interposed at a location below a stop means and above the gun.

A releasing tool is run downhole to touch bottom and then lifted in an upward direction into contact with the stop means to thereby determine if debris overlies the firing head of the tool.

The tool includes a retractable member which engages the stop means to arrest upward travel of the tool, and thereafter the member can be sheared by applying further upthrust of the tool against the stop means should it be discovered that debris overlies the firing head. This expedient enables retrieval of the tool and subsequent removal of the debris, thereby clearing the firing head so that it is rendered operative.

The hole is next re-entered with the tool where the perforating gun is detonated. Thereafter the tool is utilized to actuate the releasable coupling means so that the gun is dropped to the bottom of the well bore.

The firing and releasing tool of the present invention includes a main body having a plurality of retractable members in the form of dogs affixed thereto. The tool also includes a lower telescoping member which can be moved axially in a telescoping manner respective to the main body to thereby effectively shorten the overall length thereof. This specific construction enables the dogs of the tool to be selectively located at an elevation between the stop means and the releasable coupling means, or alternatively, to be located between the releasable coupling means and the firing head.

Accordingly, the releasing and firing tool of the present invention is run downhole to touch bottom, whereupon the dogs usually will be located at an elevation which is between the stop means and the releasable coupling. At this time, the gun can be fired, or alternatively, the dogs can be sheared into a retracted configuration, the tool removed from the hole, and corrective action taken to render the gun operative. The telescoping member next can be telescopingly moved respective to the main body to thereby relocate the dogs at an elevation which is between the releasable coupling and the firing head, whereupon the releasable coupling can then be actuated and the lower marginal end of the tool string dropped to the bottom of the borehole.

The tool of the present invention can then be removed from the borehole by shearing the dogs into a retracted configuration, which enables the tool to be lifted up through the tool string.

Therefore, a primary object of this invention is the provision of method and apparatus for completing a well bore.

Another object of the invention is to provide an optional firing and releasing tool for use in conjunction with well completion apparatus.

A further object of this invention is to disclose and provide a new combination comprising a special firing and releasing tool, a stop means, a releasable coupling means, and a downhole explosive device.

A still further object of this invention is the provision of an optional firing and releasing tool which is used in combination with a permanent completion device to enable a sequence of operational steps to be carried out wherein a downhole explosive device is detonated and thereafter dropped to the bottom of the borehole.

Another and still further object is the provision of a firing and releasing tool for use in conjunction with a downhole explosive device, wherein the explosive device is connected to a releasable coupling and wherein the tool includes means by which a determination can be made as to the operability of the firing head of the explosive device.

An additional object of this invention is the provision of a combination of elements which provides a method as well as a system for completing a borehole by utilizing a combination firing and releasing tool in carrying out a number of sequential operative manipulations which culminate in perforation of the production zone, dropping the gun to the bottom of the borehole, and retrieving the tool from the bottom of the borehole, while at the same time, production can be simultaneously carried out respective to the perforation step.

These and other objects and advantages of the invention will become readily apparent to those skilled in the art upon reading the following detailed description and claims and by referring to the accompanying drawings.

The above objects are attained in accordance with the present invention by the provision of a combination of elements and a method for completing a well bore for use with apparatus fabricated in a manner substantially as described in the above abstract and summary.

DETAILED DESCRIPTION OF THE PREFERRED EMBODIMENT

Figure 1:
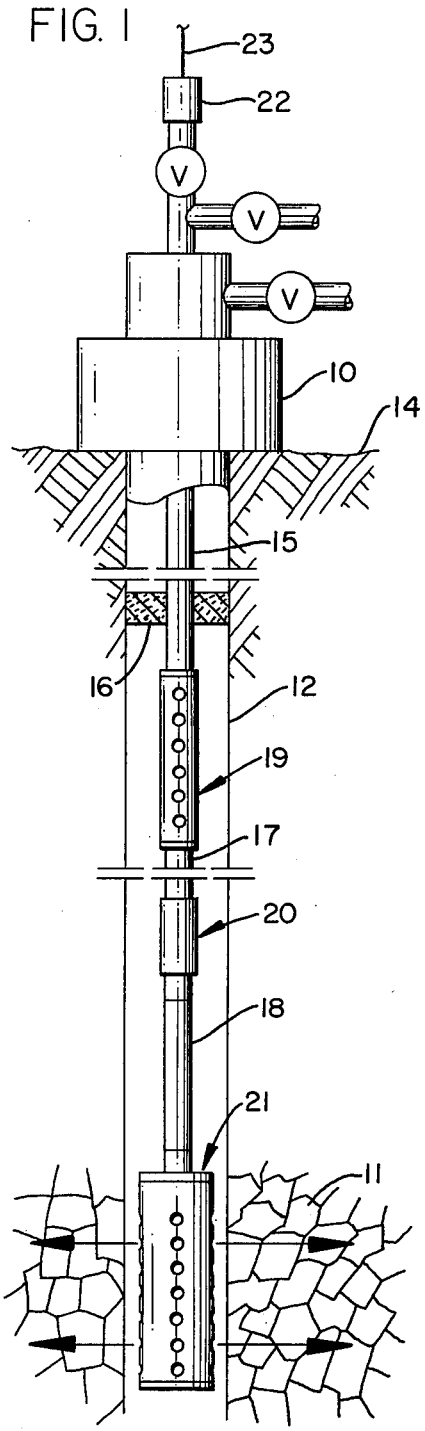
FIG. 1 is a diagrammatical representation showing a cross-sectional view of a strata of the earth having a borehole formed therein with apparatus made in accordance with the present invention disposed therein.
Figure 2:
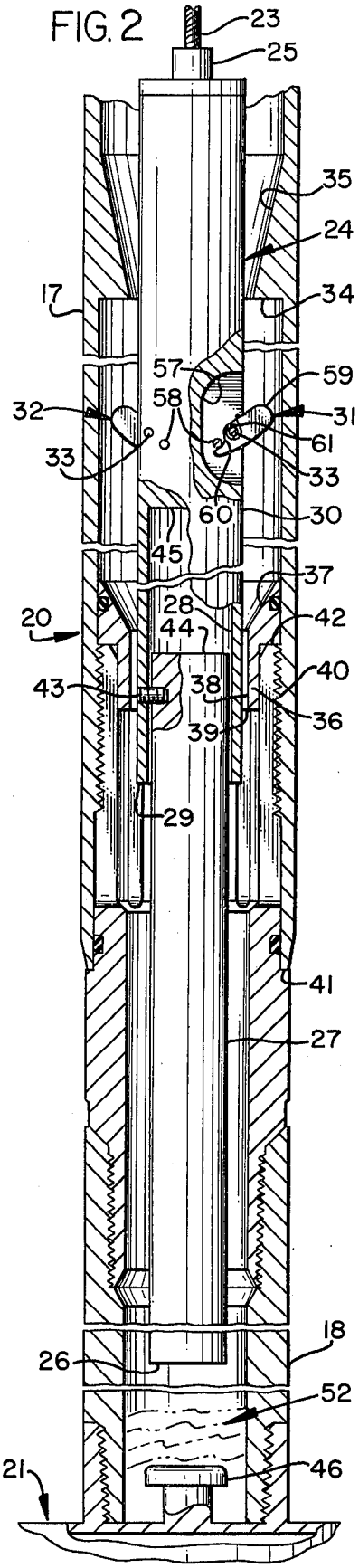
FIG. 2 is an enlarged, fragmented, longitudinal, part cross-sectional representation of part of the apparatus disclosed in FIG. 1.

FIG. 1 discloses a wellhead 10, a hydrocarbon producing zone 11, and a borehole 12 which extends from the wellhead downhole through the production zone. The surface of the ground is indicated by numeral 14. A production tubing 15 extends through a packer device 16 and continues at 17 and 18. A vent string 19, optionally made in accordance with my previous U.S. Pat. No. 3,871,448, is interposed in series relationship within the tubing string 15 and 17. A releasable coupling 20, made in accordance with my previous patent application Ser. No. 517,391, filed Oct. 23, 1974, now U.S. Pat. No. 3,966,236, or alternatively, patent application Ser. No. 691,384, filed June 1, 1976, is interposed within the production tubing. A jet perforating gun 21 is supported by the tubing string and preferably is made in accordance with my previously issued U.S. Pat. No. 3,706,344. As best seen in FIGS. 1 and 2, a lubricator 22 upwardly extends from the wellhead so that a wireline 23 can lower a tool 24, made in accordance with the present invention, down through the tubing string for a purpose which will be better appreciated later on in this disclosure.

In FIG. 2, the wireline 23 is seen to be connected to the firing and releasing tool 24 of the present invention. The cable is connected to the upper extremity of the tool by any convenient prior art means suggested by numeral 25. The lower extremity 26 of the tool preferably is in the form of an elongated cylinder 27 which is telescopingly received in a slidable manner within the hollow, cylindrical body portion 28. The body 28 terminates in a circumferentially extending edge portion 29. The outer peripheral surface 30 of the body is of a diameter to permit the tool to be received axially through the entire tool string.

Radially opposed dogs 31 and 32 are pivotally attached to the body by means of pins 33 so that the dogs may be normally biased in an outward direction in a manner to permit downhole travel of the tool. The outwardly biased pivotal dogs engage a stop means 34 when the tool is lifted uphole. The stop means 34 upwardly enlarges in a conical manner at 35 to permit a tool string to more easily be lowered in a downhole direction therethrough.

The releasable coupling 20 can take on several different forms so long as it includes a releasing member 36 which can be actuated to cause the tubing string to part. The illustrated member 36 includes an upper conical face 37 which is outwardly tapered in a manner similar to the stop means at 35. The inside peripheral wall 38 of the releasing member is of a size to receive the tool 24 axially therethrough. The releasing member terminates in a circumferentially extending shoulder 39 which is adapted to engage the uppermost end portion of the dogs when the tool is lowered through the releasing member and then brought back uphole.

Releasable load transferring means 40, which can take on several different forms, is preferably made in accordance with my before mentioned patent or my co-pending patent application Ser. No. 691,384. The releasing member and the load transferring means cooperate with the telescoping marginal ends 41 and 42 of the tubing release device such that when shoulder 39 of member 36 is engaged by the dogs of the tool and moved uphole, the load transferring members 40 are released from mutual engagement with one another, thereby enabling the tubing string to be parted at a location between the vent string and the gun. Hence, the releasable coupling parts tubing members 17 and 18, and the gun 21 is therefore free to fall to the bottom of the hole.

Numeral 43 indicates a shear pin which resists the telescoping action between members 27 and 30. The members can be forced to telescope one within another when sufficient upthrust is exerted at 26 to shear the pin of the tool. The upper end 44 of the telescoping member 27 can be forced to move in an upward direction until the upper face 44 abuttingly engages a stop means in the form of a wall 45, leaving the lower end 26 slightly protruding from shoulder 29. The shear pin 43 is of a selected size such that when the wireline 23 is rapidly slacked off and the tool allowed to accelerate a distance of several feet where it impacts against a firing head 46 of the gun, the pin will shear, thereby enabling the telescoping action to occur. Sometimes it is necessary to drop the tool several times in order to positively shear the pin of the extended member.

Figure 3:
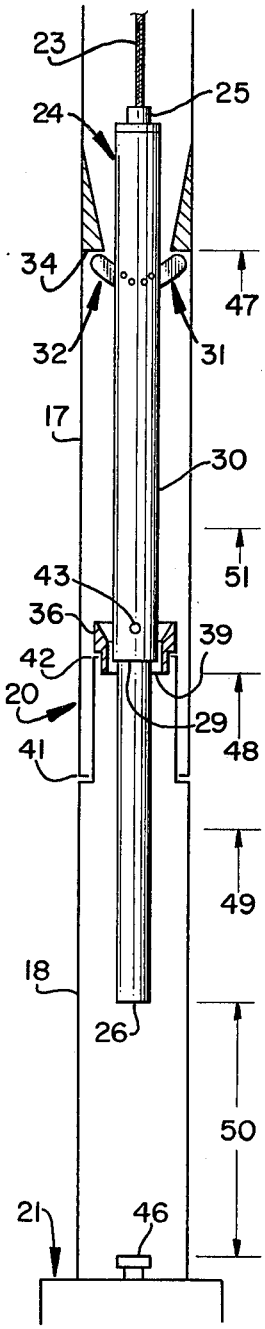
FIGS. 3–6 are part schematical, part diagrammatical representations of the apparatus disclosed in FIG. 2; and, FIG. 7 is a fragmented, part cross-sectional detail of a part of the apparatus disclosed in FIG. 2.

As best seen illustrated in FIG. 3, in conjunction with some of the remaining figures, shoulder 34 of the upper stop means, shoulder 39 of the releasing means, the firing head 46 of the gun, the terminal end 26 of the telescoping or extended member of the tool, and the dogs 31 are each arranged respective to one another to enable the steps of the present invention to be carried out in a positive manner according to the method of this invention. In particular, the different elevations 47, 48, 49, 50 respective to one another and to the firing head 46 are arranged such that when the tool is initially set down on the firing head, the dogs come to rest somewhere in proximity of location 51; that is, between the releasing member 36 and the shoulder 34 of the stop means. When the tool is jarred down to cause pin 43 to shear and member 27 to telescope up within member 30, the dogs are then located in proximity of elevation 49. That is, when the member 27 is telescoped and the tool run further downhole into engagement with the firing head, the dogs pass through the releasing member and into a position located between the releasable coupling and the firing head.

It will be noted in FIG. 3 that the tool has been positioned with the dogs underlying the upper shoulder or stop means 34. Therefore, the wireline cannot be used to bring the tool back out of the hole unless the dogs are forced into the unlatched or retracted position of FIG. 7. Accordingly, in FIG. 3 the tool can be lowered down to elevation 51 which positions the dogs intermediate of shoulders 34 and 39, with the lower end 26 of the tool engaging the firing head. Alternatively, the tool can be raised into the position of FIG. 3 and jarred down onto the firing head, thereby causing the gun to detonate. Otherwise, the tool must be further raised uphole, thereby shearing the pin 58 to release the dogs and thereby permit the tool to be retrieved from the borehole.

Figure 4:
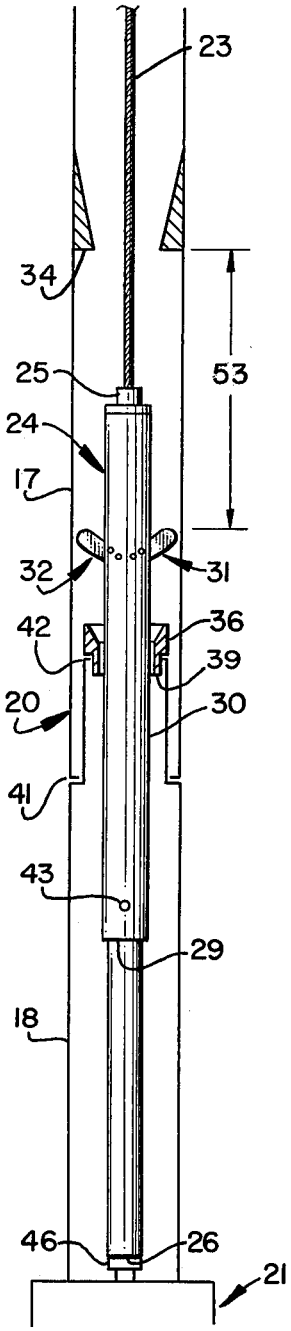

In the illustration of FIG. 4, the tool is seen to be resting on the firing head with the telescoping member in the extended configuration, and with the dogs being located intermediate the releasing coupling 20 and shoulder 34.

Figure 5:
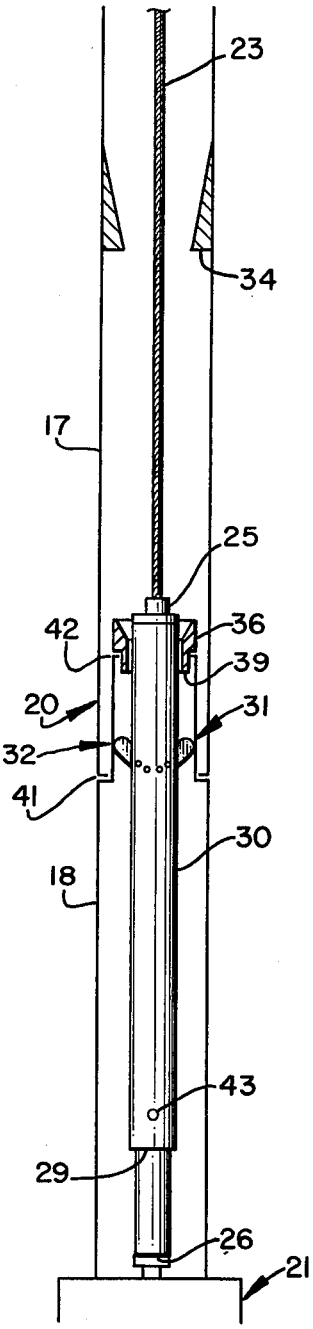
Figure 6:
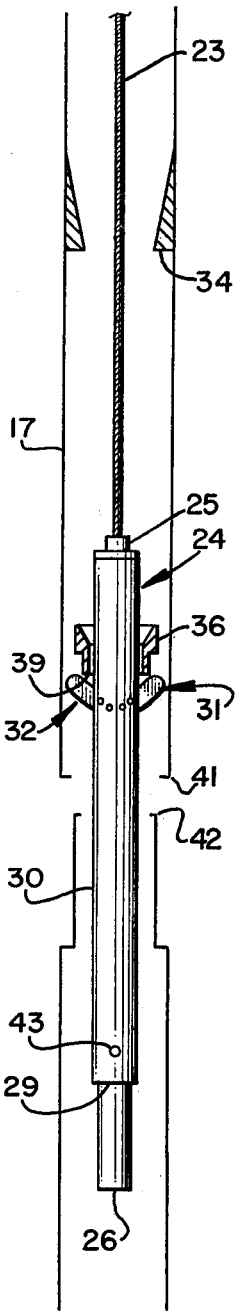

In FIG. 5, the tool has been jarred down with sufficient impact to shear the pin 43, thereby enabling member 27 to telescope up within member 30 a distance which is sufficient to cause the dogs to pass the shoulder 39 of the releasing member. Normally the gun has been fired when the tool is in the configuration of FIG. 5. Therefore, the only option now available to the wireline operator is to either leave the tool downhole or, alternatively, to raise the tool, whereby the dogs of the tool engage shoulder 39 of the releasing member of the releasing coupling, thereby moving member 36 uphole so that the terminal ends 41 and 42 of the tubing string are parted to cause the gun to fall to the bottom of the borehole. Hence FIG. 6 is a diagrammatical illustration of the method and apparatus of the present invention wherein the gun has been fired, the releasing coupling has been activated, and the lower tubing string is in the act of falling to the bottom of the borehole.

Following detonation of the gun and parting of the tool string by actuation of the releasable coupling, the wireline moves the tool uphole until the dogs move the member 36 into contact with the stop means, whereupon pins 58 are sheared to move the dogs into the unlatched configuration. The tool can now be removed from the borehole.

EXAMPLE 1

The wireline actuated releasing and firing tool is run through the lubricator and downhole until the wireline operator reaches an elevation known to be in proximity of shoulder 34. At this time the operator continues to gently lower the tool so that dogs 31 pass through shoulder 34 of the stop means, and the tool gently comes to rest in the illustrated position of FIG. 4. At this time the operator will not be absolutely certain that debris 52 of FIG. 2 is present, thereby obscuring firing head 46. In order to determine that no debris is overlying the firing head, the operator gently raises the tool until the dogs engage the stop means. With the tool in the configuration of FIG. 3, the operator notes the distance of travel indicated by numeral 50 of FIG. 3. If numeral 50 agrees with the data sheet which relates the measured distances 47, 48, and 50 gained by previous measurements before going into the hole with the tool string, then the operator knows that the firing head 46 is free of debris and the gun is ready to be detonated. At this time, the operator rapidly travels downhole with the tool so that the firing head is abuttingly engaged by the lower end of the tool, thereby causing the gun to fire and the production zone to be perforated.

Upon perforation of the zone 11, flow will occur up the annulus, into the vent string 19, up through production tubing 15, and to the surface of the ground, where the well is free flowed until it is cleaned up. Next, the tool is jarred down according to FIG. 5 and the releasable coupling is actuated according to FIG. 6 to enable the gun to drop to the bottom of the hole.

Production is lowered during this step so that the upthrust on the tool is negligible. The pins 58 are next sheared, causing the dogs to retract into pocket 57. The tool is next brought up out of the hole and through the lubricator, and the well put into production without ever having been shut in. In some formations it is permissible to shut the well in during the last stage of this operation, but in other hydrocarbon containing stratas it is advisable to always maintain a positive flow on the well to prevent contamination of the production formation.

EXAMPLE 2

The tool is run downhole as in the before described example until the wireline operator receives an indication that he has touched bottom. The operator then raises the tool into the configuration of FIG. 3 and reads the difference 50 in elevation. At this time, the operator consults his log and discovers that there is a discrepancy of several inches, indicating that debris is overlying the firing head. The tool is in the configuration of FIG. 3 at this time. The options available to the operator are to shear the pins 58 by engaging the stop means and coming out of the borehole, reentering the borehole with proper tools and removing the overlying debris so as to clear the firing head, replacing the shear pins of the tool, re-entering the hole with the firing tool, and repeating the steps set forth in Example 1. Alternatively, of course, the operator can release the releasable coupling or attempt to fire the gun. However, this would be an act of futility, because the gun would not fire and the operator naturally would never drop the gun until after the well had been completed.

According to the present invention, the instant firing and releasing tool enables a plurality of determinations to be made. The tool can be run downhole, and by utilizing previous knowledge as to the elevation of the shoulders 34 and 39 respective to the firing head, a determination can be made as to whether or not debris is overlying the firing head.

This important aspect of the invention avoids the necessity of needlessly pulling the packer, the entire tubing string, and the casing gun in order to merely wash out the debris which is overlying the firing head.

With the gun in the configuration of FIG. 2 or 3, the wireline operator has the option of shearing the pins associated with the dogs and retrieving the tool so that he can subsequently perform manipulative operations downhole in the tubing string and thereafter commence de novo after the trouble has been rectified.

Further, with the tool in the configuration of FIGS. 2 and 3, the tool can be set down on the firing head with sufficient force to fire the gun, but with insufficient force to shear the pin 43 which telescopes the members 27 and 30 together. During this stage of the operation, the tool is in the configuration of FIGS. 2, 3, and 4. Therefore, should the gun fail to fire for any reason whatsoever, the tool can be brought back uphole as noted in FIG. 3, the dogs sheared into retracted configuration, and the tool retrieved through the lubricator. At this time a decision can be made as to whether the entire packer and tubing string must be pulled in order to work on the jet perforating gun.

The importance of this stage of the operation lies in the advantage of avoiding premature actuation of the releasable coupling, because this action entails an expensive fishing job, as well as possible damage to the lower tool string.

When the tool is set down on the firing head with sufficient force to deliberately fire the jet guns, the tool is in the configuration of FIG. 4. At this stage of the operation, after the guns have been fired, the operator has the option of shearing against shoulder 34 and retrieving the tool, thereby leaving the jet gun downhole. This is sometimes a desirable expedient because the high pressure gas emerging from the formation can impinge against the outer peripheral surface of the gun, thereby reducing washout on the interial wall surface of the borehole. In this instance, production occurs up the tubing annulus, into the vent string, and then uphole to the surface of the ground.

On the other hand, the tool can be jarred down to shear the pin 43 and telescope the tool into the configuration of FIG. 5, thereby enabling the releasable coupling to be manipulated into the released configuration, whereupon the lower tubing string, along with the gun, falls to the bottom of the borehole. Production will now occur both up the tubing annulus as well as into the lower end 41 of the upper half of the released coupling.

Figure 7:
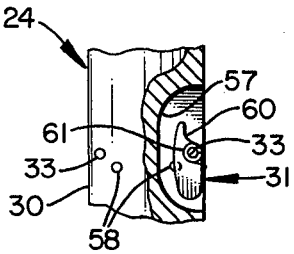

As best seen illustrated in FIGS. 2 and 7, the dogs are pivotally mounted to the main body by means of the pin 33. Radially spaced pockets 57 enable the dog to be retracted in a counterclockwise direction towards the nonengaging or retracted position, thereby enabling the tool to be run downhole with the dogs being resiliently biased in an outward direction by means of spring 61. The dog is biased in a clockwise direction with shear pin 58 acting as a stop means as it engages cutout 60 thereof. The outermost end 59 of the dog must extend clear of the inside peripheral surface of the tubing when the dog engages shoulder 34 upon being rotated clockwise through the shear pin 58 and retracted back up into the cavity where it is stored. Spring 61 is captured about the non-shearing pin 33 for positive action.

I claim:

1. Well bore completion apparatus comprising a perforating gun which includes a firing head, a releasable coupling member, an upper stop member, a packer device, and a tubing string; in combination with a firing and releasing tool;

means by which said tubing string extends axially downhole through the borehole into connection with said gun, with said firing head being located within the interior of the lower end of said tubing string;

means by which said packer is interposed in series relationship respective to the tubing string, said releasable coupling member being interposed in series relationship respective to the tubing string at a location between said packer and said gun, means locating said stop member between said releasable coupling member and said packer device;

said tool having a main body and a lower extended member, means enabling relative telescoping movement between the extended member and said main body;

said tool including radially spaced dogs which are mounted in supported relationship respective to said main body portion, means urging said dogs outwardly from said main body such that the dogs can be yieldably forced in a retractable manner into said main body so that the tool can be placed within the tubing string and lowered through said stop means and through said releasable coupling until said extended member engages said firing head;

said dogs having means associated therewith by which they are moved into a retracted position respective to said main body when said tool is lifted uphole and through said stop means;

said releasable coupling being located at an elevation above said gun head which is less than the distance measured from said dogs to the terminal end of said extended member when the member is in the extended position;

said releasing member being located a distance above said gun firing head which is greater than the distance measured from the lowermost end of the tool to the dogs when the extended member is telescoped into the retracted configuration;

whereby said tool can be lowered so that the lower terminal end thereof contacts the firing head, thereby disposing the dogs between said stop member and said releasable coupling, said extended member and said main body can be telescoped together and the tool again set down at a location where the dogs are positioned below said releasable coupling member;

said tool can be lifted in an upward direction so that the dogs engage said stop member to thereby position the dogs into the retracted configuration to enable retrieval of the tool from the borehole.

2. The apparatus of claim 1 and further including means by which said dogs are pivotally affixed to said main body such that the dogs may be pivotally rotated from without to within said main body, means biasing said dogs radially away from one another so that the dogs have a stop engaging portion lying without said main body, and a shear pin which limits the pivotal movement of the dogs as they are pivoted away from one another;

whereby said tool can be lifted uphole to engage the dogs against the stop means, the shear pin broken, so that the dogs rotate within the main body, thereby enabling the tool to be moved uphole to the surface of the ground.

3. The apparatus of claim 1 wherein said main body has a cavity within which said lower extensible member has a marginal upper end portion thereof telescopingly received, means for preventing relative movement between said main body and said extensible member, and means by which the last said means can be obviated to thereby enable said main body and said extensible member to be telescoped together.

4. The apparatus of claim 1 wherein said lower extensible member is releasably held in affixed relationship respective to said main body, means responsive to impact for releasing the extensible member from fixed relationship respective to the main body to thereby enable the extensible member to telescope together and effectively shorten the length of said tool.

5. In a well bore apparatus having a production string affixed to a packer device and extending downhole from the packer device to a perforating gun, with there being a releasable coupling member connecting the tubing together at a location between said gun and said packer, and with said gun having a firing head which is located within the interior of said tubing, the combination with said firing head and releasable coupling of a firing and releasing tool;

said firing and releasing tool having a main body, a plurality of circumferentially extending dogs, and a retractable member which is connected to and downwardly extends from said main body; means mounting said dogs to said main body in such a manner that said dogs can be retracted into said main body to thereby permit uphole movement of the tool;

a stop means positioned above said releasable coupling for engaging said dogs and arresting uphole movement of said tool;

said releasable coupling having a releasing member therein for engaging said dogs so that the dogs of the tool can engage and move the releasing member when the tool is moved uphole;

the distance measured from said releasable coupling to said gun head being shorter than the distance measured between said dogs and the lowermost end of said tool when the retractable member is extended, and being greater when the retractable member is retracted;

so that said tool can be run downhole and touch bottom, with the dogs being located at an elevation which is intermediate said stop means and said releasable coupling, whereupon the tool can then be picked up so that the dogs engage said stop means to thereby determine the distance from the bottom of the hole to the stop means;

and thereafter said tool can be run downhole to engage the firing head, or alternatively, the dogs can be retracted and the tool brought back to the surface of the ground.

6. The combination of claim 5 and further including means by which said dogs are pivotally affixed to said main body such that the dogs may be pivotally rotated from without to within said main body, means biasing said dogs radially away from one another so that the dogs have a stop engaging portion lying without said main body, and a shear pin which limits the pivotal movement of the dogs as they are pivoted away from one another;

whereby said tool can be lifted uphole to engage the dogs against the stop means, the shear pin broken, so that the dogs rotate within the main body, thereby enabling the tool to be moved uphole to the surface of the ground.

7. The combination of claim 5 wherein said main body has a cavity within which said lower extensible member has a marginal upper end portion thereof telescopingly received, means for preventing relative movement between said main body and said extensible member, and means by which the last said means can be obviated to thereby enable said main body and said extensible member to be telescoped together.

8. The combination of claim 5 wherein said lower extensible member is releasably held in affixed relationship respective to said main body, means responsive to impact for releasing the extensible member from fixed relationship respective to the main body to thereby enable the extensible member to telescope together and effectively shorten the length of said tool.

9. The method of completing a well bore comprising the steps of:

locating a perforating gun downhole on the end of a tubing string and connecting the tubing string together with a releasable coupling device;

placing a stop means in spaced relationship above said releasable coupling device;

measuring the distance from said perforating gun to said stop means;

running a firing tool downhole within the tubing string and touching bottom above the gun;

lifting the firing tool uphole and engaging said stop means to measure the spaced distance between said bottom and said stop means;

comparing the last measurement to the first measurement;

firing the gun and subsequently releasing the releasable coupling member when the first and last measurements are equal to one another;

removing the firing tool from the tubing string when the first and last measurements are unequal.

10. The method of claim 9 wherein the first and last measurements are unequal, and further including the steps of:

removing the tool from the tubing string, washing out debris which are overlying the perforating gun, re-entering the tubing string with the tool, and repeating the steps of claim 9.

11. The method of claim 9 wherein the first and last measurements are equal, and the firing step results in a misfire, and further including the steps of:

removing the tool from the tubing string, removing the gun from the borehole, rendering the gun functional, replacing the gun in the borehole, and repeating the steps of claim 9.

* * * * *